US006155507A

United States Patent [19]

Ostergaard

[11] Patent Number: 6,155,507

[45] Date of Patent: Dec. 5, 2000

[54] DEVICE FOR SECURING THE STATIONARY JAW OF A JAW CRUSHER

[75] Inventor: David A. Ostergaard, Cedar Rapids, Iowa

[73] Assignee: Cedarapids, Inc., Cedar Rapids, Iowa

[21] Appl. No.: 09/272,991

[22] Filed: Mar. 20, 1999

[51] Int. Cl.[7] ..... B02C 1/00

[52] U.S. Cl. ..... 241/264; 29/525.01

[58] Field of Search ..... 241/264–269, 241/293, 294, 295, 191, 189.1; 29/428, 525.01

[56] References Cited

U.S. PATENT DOCUMENTS

| | | | |
|---|---|---|---|
| 2,258,075 | 10/1941 | Symons | 241/191 |
| 4,039,151 | 8/1977 | Coxhill et al. | 241/191 |
| 5,172,869 | 12/1992 | Kitsukawa et al. . | |
| 5,630,555 | 5/1997 | Boyd . | |
| 5,772,135 | 6/1998 | Styles . | |
| 5,799,888 | 9/1998 | Hamaguchi et al. . | |
| 5,802,747 | 9/1998 | Nojima . | |
| 5,857,630 | 1/1999 | Hamaguchi et al. . | |

*Primary Examiner*—Mark Rosenbaum
*Attorney, Agent, or Firm*—Marshall, O'Toole, Gerstein, Murray & Borun

[57] ABSTRACT

A device for securing the stationary jaw to the frame of a jaw crusher is disclosed. The device includes a crusher frame having top and bottom spaced apart cross members, a stationary jaw, and a threaded draw rod having a pair of inwardly moveable wedge members. The stationary jaw includes a top edge, a bottom edge, and a pair of interconnecting sides, and further includes a top lug adjacent the top edge and a bottom lug adjacent the bottom edge. The top lug is adapted for placement adjacent the frame top cross member, and the bottom lug is adapted for placement adjacent the frame bottom cross member. The draw rod is disposed such that the wedge members are positioned to engage the jaw top lug and the frame top cross member. Accordingly, in response to inward movement of the wedge members, the stationary jaw is progressively more firmly secured to the frame, thereby preventing undesired movement of the stationary jaw during operation of the crusher.

29 Claims, 5 Drawing Sheets

DEVICE FOR SECURING THE STATIONARY JAW OF A JAW CRUSHER

FIELD OF THE INVENTION

The present invention relates to jaw crushers for crushing aggregate material and having a stationary crushing jaw and a moveable crushing jaw. More specifically, the present invention relates to an improved device for securing the stationary jaw to the frame of the jaw crusher.

BACKGROUND OF THE INVENTION

A typical jaw crusher includes a stationary jaw and a moveable jaw spaced to define a crushing chamber in between. Aggregate material is fed into the crushing chamber and is crushed by cooperating corrugations on the face of each of the jaws as the moveable jaw is moved repeatedly toward and away from the stationary jaw.

The jaws experience tremendous forces during operation of the crusher, and it is thus important that the stationary jaw be firmly secured to the crusher frame during operation. For example, due to the angle between the moveable jaw and the stationary jaw, the moveable jaw repeatedly applies a cyclic, upward force against the stationary jaw. Any undesired movement of the stationary jaw leads to excess wear and tear, increased down time, and hence increased operational cost of the crusher. It is thus critical that the stationary jaw be firmly secured against any up and down movement.

The tremendous forces against the jaw faces also causes the jaw faces to wear much faster than the remaining crusher components. Moreover, because of the angle between the stationary jaw and the moveable jaw alluded to above, the bottom portion of the jaw face tends to wear faster than the top portion of the jaw face. Consequently, the face of the stationary jaw is symmetrical, and the stationary jaw is removable, so that jaw can be removed, rotated, and re-installed so that the life of the jaw is effectively doubled. Accordingly, it is important that the jaws be easily attachable and removable from the crusher frame.

The crusher frame typically includes a top cross member and a bottom cross member, while the jaw includes a top lug positioned to overlie the top cross member and bottom lug positioned to underlie the bottom cross member. Traditional practice has been to insert shims between the top lug and the top cross member to draw the jaw upwardly, such that the bottom lug is wedged against the bottom cross member, thus securing the jaw to the frame. The shims were then welded in place.

Unfortunately, the use of shims, which must be sized in discrete sizes, makes it difficult to find the right size shim to exert the desired amount of upward force against the jaw. Moreover, because the shims must be welded in place and then cut away in order to tighten remove, replace, and/or flip the jaw, access must be gained to the middle of the crusher. Gaining such access is often difficult, time consuming, and hence expensive, as other components such as bypass chutes or conveying equipment is often in the way. Moreover, the repeated welding, cutting, and re-welding of the shims often damages the crusher frame.

Accordingly, an improved system for securing the stationary jaw to the jaw crusher frame is desired.

SUMMARY OF THE INVENTION

A device for securing the stationary jaw to the frame of a jaw crusher according to the present invention provides better, more positive securement of the jaw to the frame, faster and easier installation and removal of the stationary jaw, lowers operating costs, and/or prolongs the service life of the stationary jaw.

According to one aspect of the invention, a jaw crusher includes a frame having top and bottom spaced apart cross members, a stationary jaw, and a threaded draw rod having a pair of inwardly moveable wedge members. The stationary jaw includes a top edge, a bottom edge, and a pair of interconnecting sides, and further includes a top lug adjacent the top edge and a bottom lug adjacent the bottom edge. The top lug is adapted for placement adjacent the frame top cross member, and the bottom lug is adapted for placement adjacent the frame bottom cross member. The draw rod is disposed such that the wedge members are positioned to engage the jaw top lug and the frame top cross member. Accordingly, in response to inward movement of the wedge members, the stationary jaw is progressively more firmly secured to the frame, thereby preventing undesired movement of the stationary jaw during operation of the crusher.

In further accordance with a preferred embodiment of the invention, the top and bottom cross members are spaced apart a first distance, and the stationary jaw top and bottom lugs are spaced apart a second distance, with the second distance being slightly greater than the first distance. The draw rod preferably includes a pair of ends and a nut on each draw rod end for moving the wedge members inwardly. The frame may include a pair of opposing sidewalls, each of which may include an access opening, such that the draw rod ends are accessible through the access openings.

Each wedge member may include a bore, with the draw rod extending through each wedge member bore. Each wedge member bore may include an outer threaded portion, with the outer threaded portion being accessible upon the removal of the draw rod and being adapted for connection to a pulling tool. The pulling tool may be used to withdraw each wedge member through its adjacent access opening.

The frame top cross member includes a pair of tapered outer ends, and each wedge member may be also be tapered to complement the taper of the cross member outer ends. Preferably, the top cross member outer ends and the wedge members are tapered at an angle of approximately 8 degrees. The outer end of the top cross member may define a longitudinal track, and each of the wedge members may be adapted to slidably engage the adjacent longitudinal track. Each longitudinal track may be defined in part by a pair of upwardly extending flanges, and each wedge member may include a key sized to be received between the flanges of the adjacent track, such that threaded nuts applied to the opposing ends of the draw rod may draw each wedge member inwardly along the longitudinal track. Preferably, the upwardly facing surface of each top cross member outer end is sloped downwardly toward its adjacent side, so that upon inward movement of the wedge members the wedge members apply an upward force to the jaw top lug, thereby upwardly forcing the jaw bottom lug against the frame bottom cross member.

According to another aspect of the invention, on a jaw crusher having a frame, a stationary jaw and a moveable jaw, a device is provided for securing the stationary jaw to the frame. The device comprises top and bottom spaced apart cross members carried by the frame, with the stationary jaw having a top edge having a top lug, a bottom edge having a bottom lug, and a pair of interconnecting sides. The top and bottom lugs are adapted to engage the top and bottom cross members. A transversely oriented securement mechanism is provided which engages one of the stationary jaw lugs and an adjacent one of the frame cross members. The securement mechanism is adapted to apply a progressively greater upward force to the stationary jaw, thereby firmly securing the stationary jaw to the frame.

According to yet another aspect of the invention, on a jaw crusher having a frame, a pair of jaw members, and a crushing chamber defined between the pair of jaw members, a device for securing one of the jaw members to the frame comprises a pair spaced apart cross members mounted to the frame and extending between opposing sides thereof, with the cross members being spaced apart by a first distance. The one jaw member includes a top edge having a top mounting lug and a bottom edge having a bottom mounting lug, with the top mounting lug and the bottom mounting lug being spaced apart by a second distance greater than the first distance to thereby define a gap between one of the mounting lugs and an adjacent one of the cross members. A draw rod having a pair of wedge members is provided and is disposed such that the wedge members are positioned in the gap so as to engage the one jaw mounting lug and the adjacent one frame cross member. An actuating member is mounted to the draw rod adjacent each of the wedge members, with each actuating member being adapted for inward movement along the draw rod to thereby apply an inward force on the adjacent wedge member. Accordingly, upon inward movement of the wedge members the stationary jaw is wedged tightly against the frame.

According to a further aspect of the invention, a method for securing a jaw member having top and bottom mounting lugs to the frame of a jaw crusher comprises the steps of providing a pair of frame members, one of the frame members having a pair of tapered outer ends, positioning each jaw member mounting lug generally adjacent to a corresponding one of the frame members, positioning a threaded jaw rod having a pair of inwardly moveable wedge members between the one frame member and its adjacent mounting lug, and drawing the wedge members inwardly to so that a force is applied to the jaw member, thereby drawing the jaw member into firm contact with the frame.

The aforementioned features and advantages, in addition to other features and advantages, will become readily apparent to those skilled in the art upon a reading of the following detailed description.

DETAILED DESCRIPTION OF THE PREFERRED EMBODIMENT

The embodiment described herein is not intended to be exhaustive or to limit the scope of the invention to the precise form disclosed. The following embodiment has been chosen and described in order to best explain the principles of the invention and to enable others skilled in the art to follow its teachings.

Figure 1:
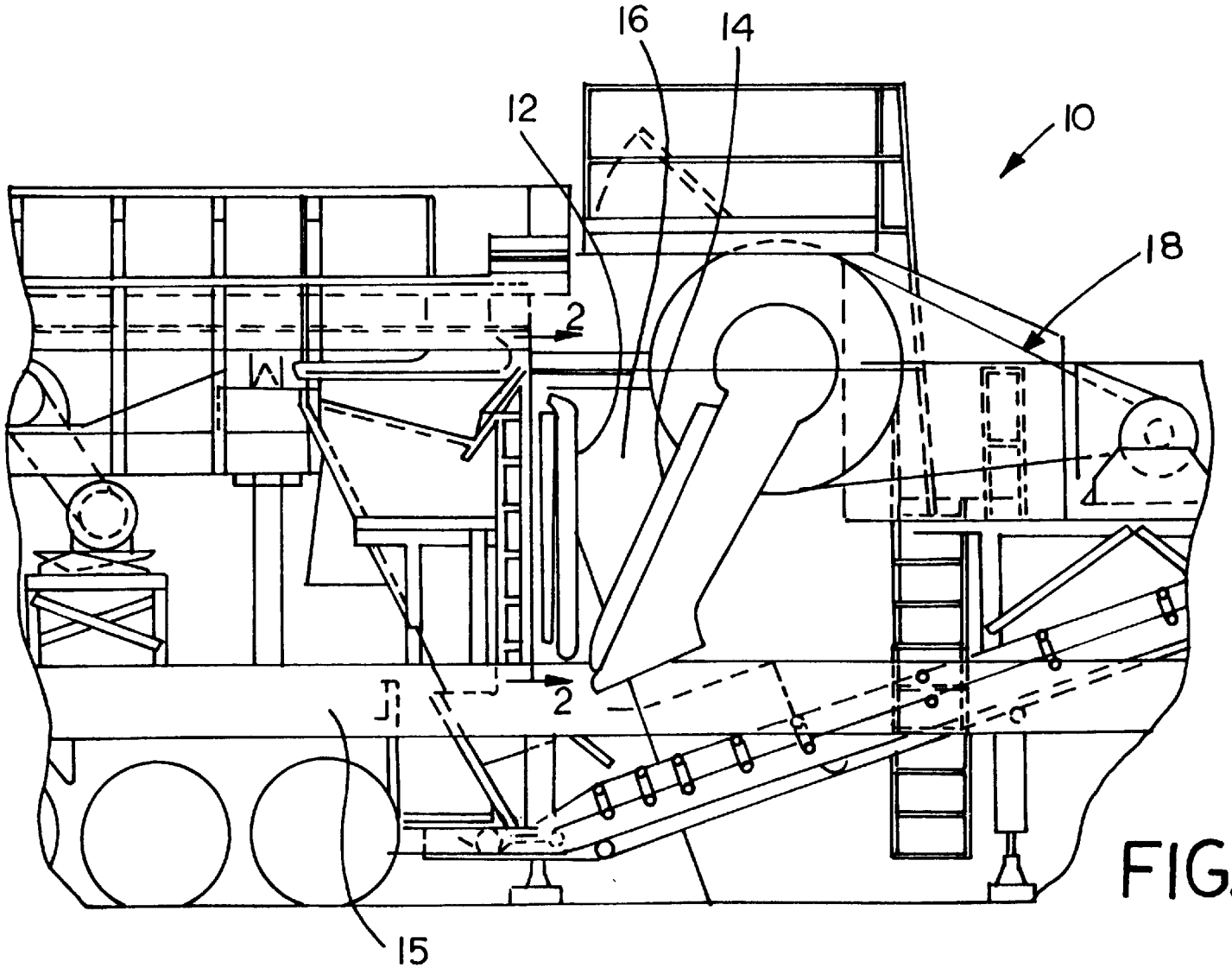
FIG. 1 is a fragmentary elevational view of a typical jaw crusher having a stationary jaw and a moveable jaw and having a portion of the sidewall cut away.

Referring now to the drawings, FIG. 1 illustrates a jaw crusher 10 of the type generally well known in the art. The jaw crusher 10 includes a stationary jaw 12 and a moveable jaw 14, which are mounted to a mounting frame 15 and which are spaced apart to define a crushing chamber 16 between the stationary jaw 12 and the moveable jaw 14. The jaw crusher 10 also includes a drive system 18 of the type generally well known in the art and which is adapted to reciprocate the moveable jaw 14 back and forth relative to the stationary jaw 12 so as to crush aggregate material fed into the crushing chamber 16 by a conventional feed system. The jaw crusher 10 also includes a variety of other system components (not shown), all of which are known to those skilled in the art.

The stationary jaw 12 may be conventionally secured to the frame 15 against both vertical and side-to-side movement. An alternative manner of securing the stationary jaw 12 to the frame 15 against movement is described in co-pending U.S. patent application Ser. No. 09/272,934, entitled "Double Wedge Key Plates for a Jaw Crusher", the entire disclosure of which is incorporated herein by reference, and which is owned by the assignee of the present application.

Figure 2:
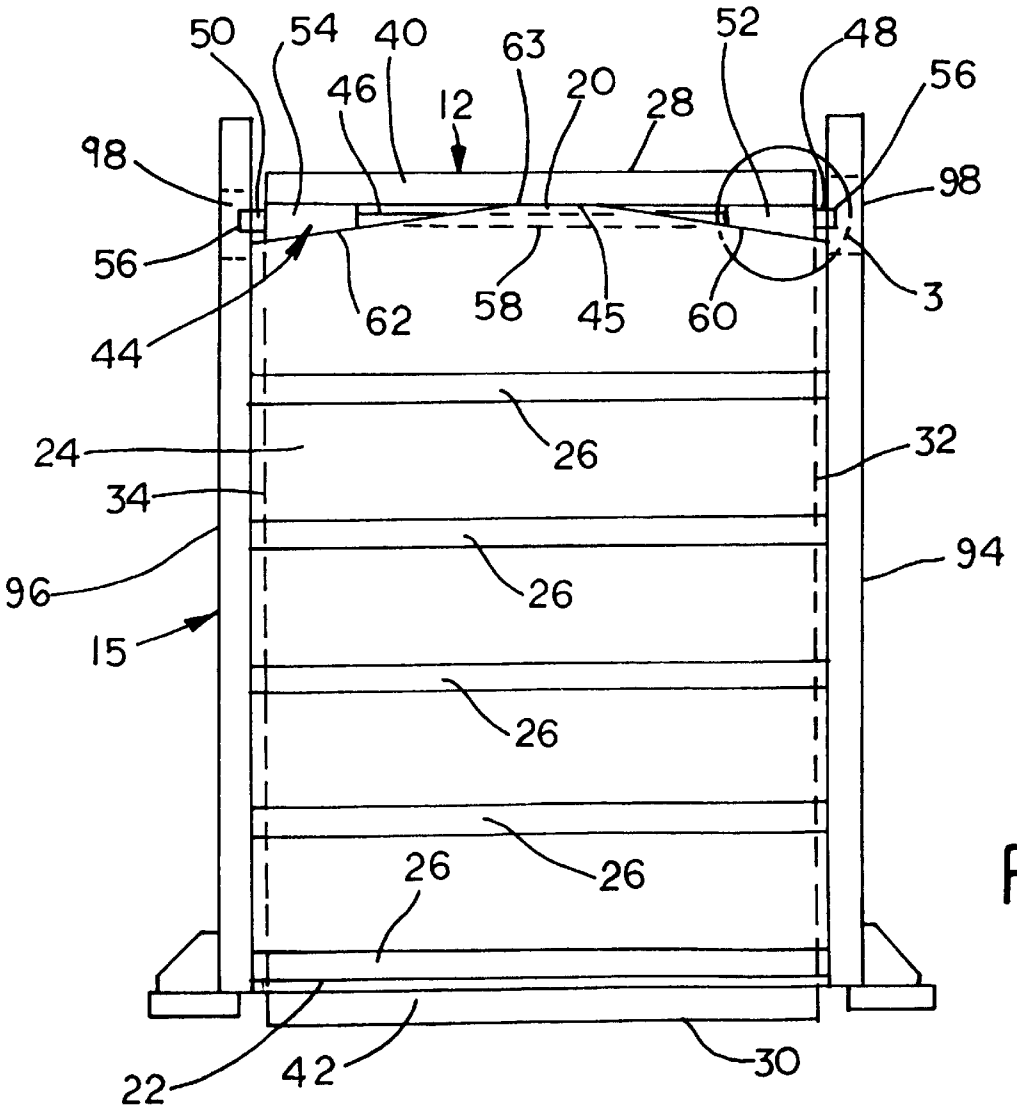
FIG. 2 is an enlarged fragmentary elevational view taken along line 22 of FIG. 1 and illustrating a device for securing the stationary jaw to the jaw crusher frame constructed in accordance with the teachings of the present invention.

Referring now to FIG. 2, the mounting frame 15 includes a top portion 20 and a bottom portion 22. As may be appreciated in FIGS. 2, 5 and 7, the top portion 20 and the bottom portion 22 are preferably defined by a continuous plate member 24, although as an alternative separate top and bottom cross-members (not shown) may be employed. The plate member 24 is preferably stiffened and strengthened by a plurality of stiffeners 26.

As shown in FIGS. 2–6, the stationary jaw 12 includes a top edge 28, a bottom edge 30, and a pair of interconnecting sides 32 and 34. The stationary jaw 12 also preferably includes a corrugated face 36 as would be conventional, and is also preferably symmetrical about a horizontal centerline 38 so as to include an upper portion 39 and a lower portion 41. The stationary jaw also includes a top mounting lug 40 generally adjacent to the top edge 28, and also includes a bottom mounting lug 42 generally adjacent to the bottom edge 30. As can be seen in FIG. 2, the top and bottom lugs 40, 42 are spaced on the stationary jaw 12 such that the top lug 40 generally overlies the top portion 20 of the mounting plate 24, while the bottom lug 42 generally underlies the bottom portion 22 of the mounting plate 24. It will be noted that the bottom mounting lug 42 is adapted to bear against the bottom portion 22 of the mounting plate 24 in response to an upward force applied to the stationary jaw 12 as will be explained below. It will be noted from FIG. 5 that when the stationary jaw 12 is so disposed, a small gap 45 is created. It will be understood that for purposes of illustration only, when viewing FIG. 5 this gap 45 is shown between the top portion 20 of the mounting plate 24 and the top mounting lug 40 of the stationary jaw 12. It will also be understood that, absent any support, the stationary jaw 12 would naturally shift downwardly relative to the mounting plate 24 and "hang" on its top mounting lug 40.

Figure 3:
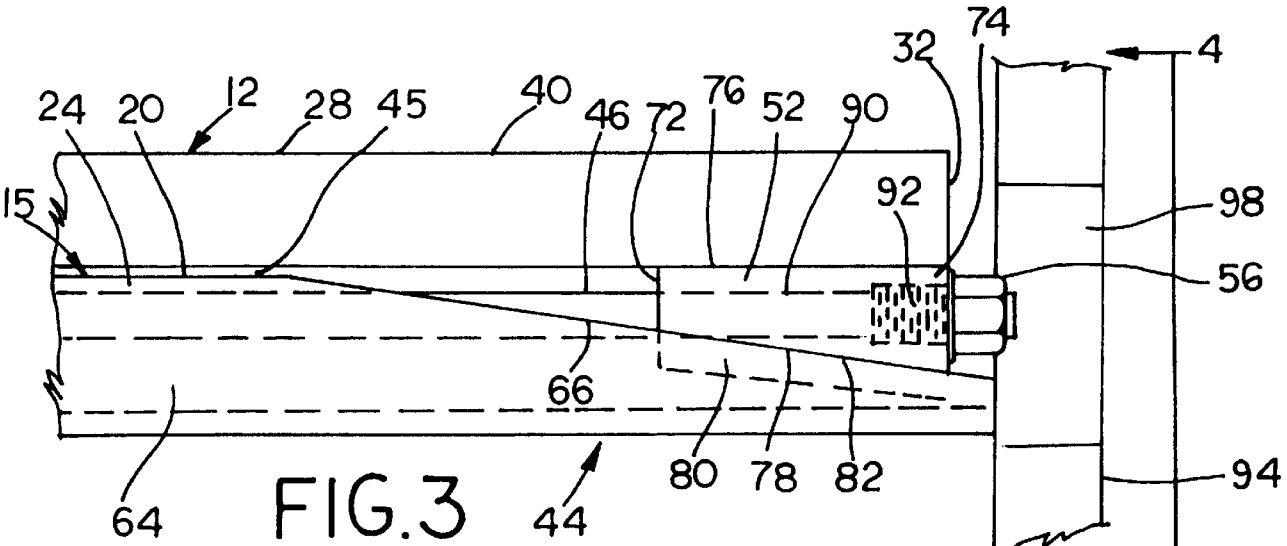
FIG. 3 is an enlarged fragmentary elevational view taken about the circumscribed portion of FIG. 2.
Figure 4:
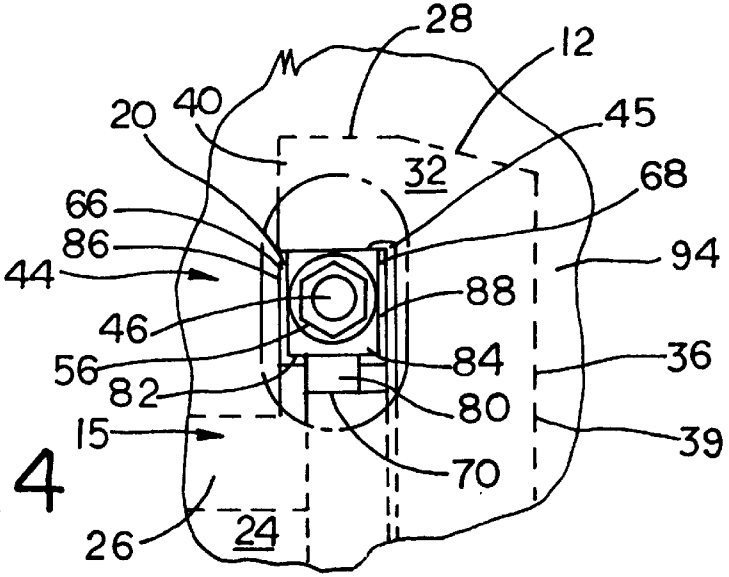
FIG. 4 is an enlarged fragmentary elevational view taken along line 44 of FIG. 3.

As shown in FIGS. 2–4, in order to keep the stationary jaw 12 firmly attached to the mounting frame 15, a securement mechanism 44 is provided. In the embodiment illustrated in the drawings, the securement mechanism is implemented by a threaded draw rod 46 having a pair of ends 48, 50, and having a wedge member 52, 54 attached to the ends 48, 50, respectively of the threaded draw rod 46. A nut 56 is provided at each end 48, 50, for moving the wedge members 52, 54 in a generally inward direction toward a center 58 of the draw rod 46.

The top portion 20 of the mounting plate 24 includes a pair of sloped or tapered end portions 60, 62, which may be separated by a generally flat or level central portion 63. Preferably, the tapered end portions 60, 62 are sloped at an angle of approximately eight (8) degrees from the horizontal. The top portion 20 also includes a passage 64 extending between the edge portions 60, 62, with the passage 64 being bounded by a pair of upwardly extending flanges 66, 68 defining a longitudinal track 70.

Figure 7:
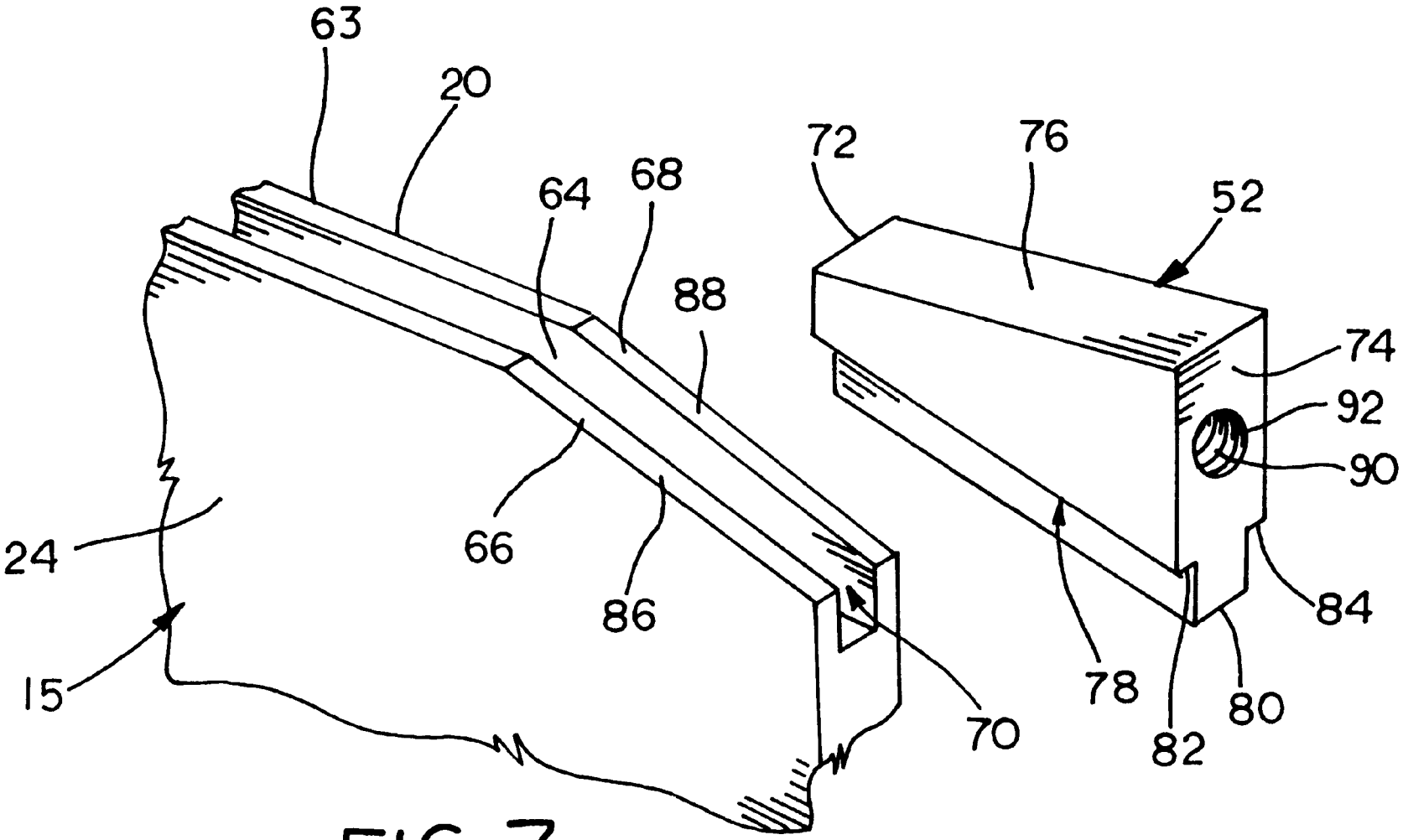
FIG. 7 is an enlarged fragmentary exploded view in perspective illustrating the top portion of the crusher frame and one of the wedge members.

Referring now to FIG. 7, the wedge member 52 is shown in greater detail. It will be appreciated that the wedge member 54 is substantially the same as the wedge member 52, and thus for the purposes of brevity only the wedge member 52 will be described in detail. The wedge member 52 includes an inner end 72, an outer end 74, a top surface 76, and a sloped bottom portion 78 extending between the inner and outer ends 72, 74. As will be outlined in greater detail below, the top surface 76 is adapted to bear against an adjacent bottom surface of the top mounting lug 40 of the stationary jaw 12.

The sloped bottom portion 78 is sloped at an angle of approximately eight (8) degrees in order to match the angle of the tapered end portions 60, 62 described above. Naturally, in the event the angle of the tapered end portions 60, 62 were to be changed, then a corresponding change would be made to the angle of the sloped bottom portion 78 of the wedge member 52.

As shown in FIG. 7, the sloped bottom portion 78 of the wedge member 52 may optionally include a downwardly extending key or tab 80 bounded by a pair of edges 82, 84. The tab 80 and the edges 82, 84 are sized so that the tab 80 fits within the passage 64 of the track 70, with the edges 82, 84 riding on a sloped upper surface 86, 88 of the upwardly extending flanges 66, 68, respectively. It will be understood that each flange 66, 68 includes the sloped upper surface 86, 88 on each end thereof. Although the bottom surface of the tab 80 is shown as being sloped and therefore parallel to the sloped bottom portion 78, the bottom surface of the tab 80 may also be straight or level (i.e., parallel to the top surface 76 of the wedge 52. It will be noted that, in the event the tab 80 is dispensed with, the edges 82, 84 will be contiguous with each other (i.e., the sloped bottom surface 78 extends across the thickness of the wedge member 52).

The wedge 52 also includes a bore 90 extending between the inner and outer ends 72, 74 which is sized to receive therethrough the draw rod 46. As shown in each of FIGS. 3 and 7, the bore 90 includes an outer threaded portion 92.

Referring now to FIGS. 2, 3 and 4, the jaw crusher 10 includes a pair of sidewalls 94, 96, each of which includes an access opening 98 therethrough. The access opening 98 is located on the sidewalls 94, 96 such that the openings 98 are generally in line with the draw rod 46, and are large enough to permit removal of the nuts 56 and extraction of the wedge members 52, 54 in the manner to be explained below.

In operation, the jaw crusher 10 is operated according to conventional practices in a manner well known in the art. As is known to those skilled in the art, the stationary jaw 12 experiences a cyclic and generally upward load in response to operation of the moveable jaw 14. Accordingly, the stationary jaw 12 must be firmly secured to the frame 15 such that any vertical movement is prevented. Further, during the course of operation of the jaw crusher 10, the corrugated face 36 wears unevenly (i.e., the lower portion 41 wears faster than the upper portion 39). Accordingly, the stationary jaw 12 may be removed, rotated about its centerline 38, and can be then re-attached.

Figure 5:
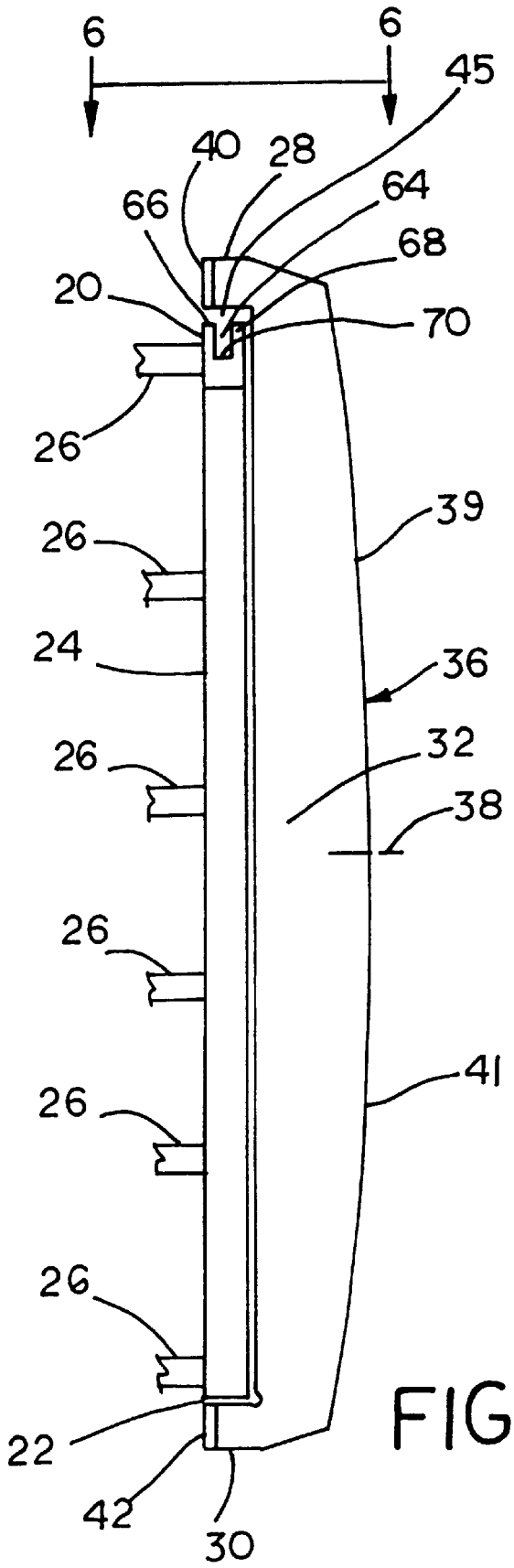
FIG. 5 is an enlarged fragmentary elevational view illustrating the lugs of the stationary jaw disposed adjacent the crusher frame.
Figure 6:
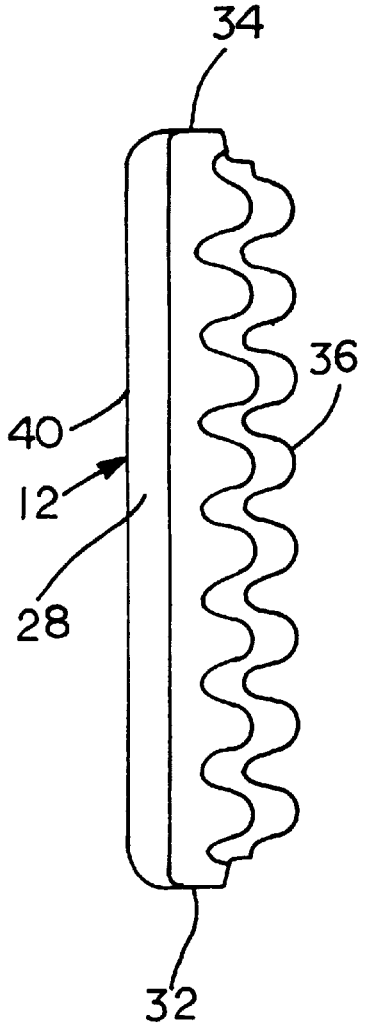
FIG. 6 is a top plan view taken along line 6—6 of FIG. 5 and illustrating the corrugated face of the stationary jaw.

The stationary jaw 12 is positioned as shown in FIG. 5 with the top mounting lug 40 overlying the top portion 20 and with the bottom mounting lug 42 underlying the bottom portion 22. The securement mechanism 44 is positioned as shown in FIGS. 2–4, with the wedge members 52, 54 disposed in the track 70 and with the bottom sloped portion 78 engaging the sloped portions 86, 88 of the flanges 66, 68. The draw rod 46 is inserted though the bore 90 of the wedge member 52, the passage 64 through the top portion 20, and through the bore 90 of the wedge member 54 using either access opening 98.

Using a nut 56 on each end 48, 50 of the draw rod 46, the wedge members 52, 54 are gradually forced inwardly, thus raising the stationary jaw 12 in a stepless manner. The stepless lifting of the stationary jaw 12 caused by the wedging action between the top mounting lug 40 and the top portion 20 of the mounting plate 24 slightly increases the gap 45, and pulls the bottom mounting lug 42 into firm engagement with the bottom portion 22 of the mounting plate 24. The stationary jaw 12 is thus firmly secured to the frame 15. The stationary jaw 12 can be further tightened without having to gain access to the top portion 20 of the mounting plate 24 (which typically could only be accomplished by removing various interfering components of the jaw crusher 10).

It will be understood that, upon removal of the nuts 56 and extraction of the draw rod 46, either of the wedge members 52, 54 may be removed by inserting a conventional pulling tool such as a slide rod or a hydraulic puller (not shown) by securing the pulling tool to the threaded portion 92 of the bore 90. The pulling tool may be inserted through the access opening 98 in either side 94, 96 of the crusher 10, and the nuts 56 and the wedge members 52, 54 may be extracted through their adjacent access openings 98. The stationary jaw 12 may then be removed.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which come within the scope of the appended claims is reserved.

What is claimed:

1. A jaw crusher, comprising:

a frame having top and bottom spaced apart cross members;

a stationary jaw, the stationary jaw having a top edge, a bottom edge, and a pair of interconnecting sides, the stationary jaw including a top lug adjacent the top edge and a bottom lug adjacent the bottom edge, the top lug being adapted for placement adjacent the frame top cross member, the bottom lug being adapted for placement adjacent the frame bottom cross member; and a threaded draw rod having a pair of ends, and further including a pair of inwardly moveable wedge members, one of the wedge members being disposed adjacent each of the draw rod ends, the draw rod being disposed such that the wedge members are positioned to engage the jaw top lug and the frame top cross member;

whereby in response to inward movement of the wedge members the stationary jaw is progressively more firmly secured to the frame, thereby preventing undesired movement of the stationary jaw during operation of the crusher.

2. The jaw crusher of claim 1, wherein the top and bottom cross members are spaced apart a first distance, and wherein the stationary jaw top and bottom lugs are spaced apart a second distance, the second distance being slightly greater than the first distance.

3. The jaw crusher of claim 1, wherein the draw rod includes a pair of ends, and further including a nut on each draw rod end for moving the wedge members inwardly.

4. The jaw crusher of claim 1, wherein the frame includes a pair of opposing sidewalls, each of the sidewalls including an access opening, and wherein the draw rod includes a pair of ends, the draw rod being disposed such that each draw rod end is accessible through an adjacent sidewall opening.

5. The jaw crusher of claim 1, wherein each wedge member includes a bore, the draw rod extending through each wedge member bore.

6. The jaw crusher of claim 5, wherein each wedge member bore includes an outer threaded portion, the outer threaded portion being accessible upon the removal of the draw rod and being adapted for connection to a pulling tool, thereby permitting the removal of each wedge member through its adjacent access opening.

7. The jaw crusher of claim 1, wherein the frame top cross member includes a pair of outer ends, each of the outer ends being outwardly tapered, and further wherein each wedge member is inwardly tapered, the taper of each top cross member outer end being complementary with the taper of the adjacent wedge member.

8. The jaw crusher of claim 7, wherein each top cross member outer end and each wedge is tapered at an angle of approximately 8 degrees.

9. The jaw crusher of claim 1, wherein the frame top cross member includes a pair of outer ends, each of the outer ends defining a longitudinal track, and further wherein each of the wedge members is adapted to slidably engage the adjacent longitudinal track.

10. The jaw crusher of claim 9, wherein each longitudinal track is defined in part by a pair of upwardly extending flanges, and further wherein each wedge member includes a key sized to be received between the flanges of the adjacent track.

11. The jaw crusher of claim 1, wherein the frame top cross member includes a pair of tapered outer ends and further wherein each wedge member is tapered to match the taper of its adjacent outer end, each top cross member outer end further including a pair of upwardly extending flanges defining a longitudinal track, each wedge member including a tab adapted for slidable engagement with its adjacent track.

12. The jaw crusher of claim 11, wherein the draw rod includes a pair of ends and a nut on each end for drawing the wedge members inwardly.

13. The jaw crusher of claim 11, wherein the frame includes a pair of sides and wherein the top cross member includes an upwardly facing surface, the upwardly facing surface of each top cross member outer end being sloped downwardly toward its adjacent side, so that upon inward movement of the wedge members the wedge members apply an upward force to the jaw top lug, thereby upwardly forcing the jaw bottom lug against the frame bottom cross member.

14. On a jaw crusher having a frame, a stationary jaw and a moveable jaw, a device for securing the stationary jaw to the frame comprising:

top and bottom spaced apart cross members carried by the frame;

the stationary jaw having a top edge, a bottom edge, and a pair of interconnecting sides, the stationary jaw further including a top lug adjacent the top edge and a bottom lug adjacent the bottom edge, the top and bottom lugs being adapted to engage the top and bottom cross members; and a transversely oriented securement mechanism engaging one of the stationary jaw lugs and an adjacent one of the frame cross members, the securement mechanism being adapted to apply a progressively greater force to the stationary jaw, thereby firmly securing the stationary jaw to the frame.

15. The jaw crusher of claim 14, wherein the frame includes a pair of sidewalls, each sidewall including an access opening, thereby permitting access to the securement mechanism.

16. The jaw crusher of claim 14, wherein the securement mechanism engages the frame top cross member and the stationary jaw top lug.

17. The jaw crusher of claim 14, wherein the securement mechanism includes a threaded draw rod extending across the frame and having a pair of ends and having a tapered member adjustably mounted to each end, and wherein one of the frame cross members includes a pair of tapered outer ends adapted to receive an adjacent one of the tapered members, and a threaded nut attached to each draw rod end for drawing the tapered members inwardly.

18. The jaw crusher of claim 17, wherein each member includes a bore, the draw rod extending through each tapered member bore.

19. The jaw crusher of claim 18, wherein the cross member having the tapered ends includes a passage adapted to receive the draw rod.

20. The jaw crusher of claim 18, wherein each wedge member bore includes an outer threaded portion, the outer threaded portion being accessible upon the removal of the draw rod and being adapted for connection to a pulling tool to thereby permit the removal of tapered member.

21. On a jaw crusher having a frame, a pair of jaw members, and a crushing chamber defined between the pair of jaw members, a device for securing one of the jaw members to the frame comprising:

a pair spaced apart cross members mounted to the frame and extending between opposing sides thereof, the cross members being spaced apart by a first distance;

the one jaw member including a top edge having a top mounting lug and a bottom edge having a bottom mounting lug, the top mounting lug and the bottom mounting lug being spaced apart by a second distance greater than the first distance to thereby define a gap between at least one of the mounting lugs and an adjacent one of the cross members;

a draw rod having a pair of wedge members, the draw rod being disposed such that the wedge members are positioned in the gap and engaging the one jaw mounting lug and the adjacent one frame cross member; and an actuating member mounted to the draw rod adjacent each of the wedge members, each actuating member being adapted for inward movement along the draw rod to thereby apply an inward force on the adjacent wedge member;

whereby upon inward movement of the wedge members the stationary jaw is wedged tightly against the frame.

22. The jaw crusher of claim 21, wherein the draw rod is threaded and wherein each actuating member is a threaded nut.

23. A method for securing a jaw member having top and bottom mounting lugs to the frame of a jaw crusher, comprising the steps of:

providing a pair of frame members, one of the frame members having a pair of tapered outer ends;

positioning each jaw member mounting lug generally adjacent to a corresponding one of the frame members;

positioning a threaded jaw rod having a pair of inwardly moveable wedge members between the one frame member and its adjacent mounting lug; and drawing the wedge members inwardly to so that a force is applied to the jaw member, thereby drawing the jaw member into firm contact with the frame.

24. A jaw crusher, comprising:

a frame having top and bottom spaced apart cross members, at least one of the cross members defining a longitudinally extending track;

a stationary jaw, the stationary jaw having a top edge, a bottom edge, and a pair of interconnecting sides, the stationary jaw including a top lug adjacent the top edge and a bottom lug adjacent the bottom edge, the top lug being adapted for placement adjacent the frame top cross member, the bottom lug being adapted for placement adjacent the frame bottom cross member; and an adjustable securement mechanism including a threaded draw rod and a pair of inwardly moveable rigid wedge members, the draw rod including a pair of ends, each of the wedge members being operatively associated with one of the draw rod ends, the wedge members being adapted to engage the track and at least one of the top and bottom lugs so that in response to inward movement of the wedge members the stationary jaw is progressively more firmly secured to the frame.

25. A jaw crusher, comprising:

a frame having top and bottom spaced apart cross members, at least one of the cross members being adapted to define a sloping guide track;

a stationary jaw, the stationary jaw having a top edge, a bottom edge, and a pair of interconnecting sides, the stationary jaw including a top lug adjacent the top edge and a bottom lug adjacent the bottom edge, the top lug being adapted for placement adjacent the frame top cross member, the bottom lug being adapted for placement adjacent the frame bottom cross member;

a threaded draw rod having a pair of ends; and a pair of wedge members, each of the wedge members being adapted to engage one of the draw rods ends and further being adapted to slidably engage the guide track, the wedge members and the draw rod being disposed such that a horizontal portion of each wedge member engages a corresponding horizontal portion defined by at least one of the top or bottom lugs of the jaw;

so that upon inward movement of the wedge members along the draw rod the stationary jaw is secured to the frame.

26. A jaw crusher, comprising:

a frame having first and second cross members spaced apart a first distance, at least one of the cross members being adapted to define a linear track;

a stationary jaw, the stationary jaw having first and second spaced apart mounting edges, each of the spaced apart mounting edges having a lug generally adjacent thereto, the lugs being spaced apart a second distance greater than the first distance, thereby permitting placement of the stationary jaw adjacent the frame with each of the lugs disposed adjacent one of the cross members;

a threaded draw rod having first and second spaced apart ends; and first and second wedge members, each of the wedge members being adapted to slidably engage the linear track, the first wedge member adjustably engaging the first draw rod end and the second wedge member adjustably engaging the second draw rod end so that each of the draw rods ends includes only a single wedge member, the draw rod and the wedge members being positionable along the linear track with the wedge members disposed to engage an adjacent one of the lugs, whereby upon placement of the stationary jaw adjacent the frame and upon inward movement of the wedge members along the draw rod the stationary jaw is progressively more firmly secured to the frame.

27. The jaw crusher of claim 26, wherein the track is defined in part by a pair of spaced apart flanges.

28. The jaw crusher of claim 26, wherein the track includes a longitudinal passage, and further wherein each wedge member includes a tab adapted to extend into the passage.

29. The jaw crusher of claim 26, wherein the track is defined by a pair of spaced apart flanges separated by a passage, each of the flanges including a sloping portion, and wherein each wedge member includes a tab member sized to be received in the passage, each of the wedge members further including a pair of sloped edges adapted to engage the flanges.

* * * * *